US005211127A

United States Patent [19]

Sprunger

[11] Patent Number: 5,211,127

[45] Date of Patent: May 18, 1993

[54] MOBILE BOAT

[76] Inventor: Powell L. Sprunger, 20 Woodview La., Algonquin, Ill. 60102

[21] Appl. No.: 834,645

[22] Filed: Feb. 12, 1992

Related U.S. Application Data

[63] Continuation-in-part of Ser. No. 523,103, May 14, 1990, abandoned.

[51] Int. Cl.[5] ..... B60P 3/10

[52] U.S. Cl. ..... 114/344; 280/414.2

[58] Field of Search ..... 114/343, 344, 361; 280/414.1, 414.2

[56] References Cited

U.S. PATENT DOCUMENTS 2,929,079 3/1960 Totten ..... 114/344
3,159,410 12/1964 Raymond ..... 280/414.2
3,337,243 8/1967 Rued ..... 280/414.2

FOREIGN PATENT DOCUMENTS 955636 1/1950 France ..... 114/344

*Primary Examiner*—Jesus D. Sotelo
*Attorney, Agent, or Firm*—Powell L. Sprunger

[57] ABSTRACT

A mobile boat comprising, a hull having a space, a pair of wheels on opposed sides and adjacent an upper portion of the hull for placement of the hull in an inverted configuration for transport, and a hitch for a vehicle adjacent a forward portion of the hull.

6 Claims, 2 Drawing Sheets

MOBILE BOAT

CROSS-REFERENCE TO RELATED APPLICATION

This application is a continuation-in-part of application Ser. No. 523,103, filed May 14, 1990, now abandoned.

BACKGROUND OF THE INVENTION

The present invention relates to boats.

Before the present invention, boats have been placed on trailers in order to transport them by a vehicle between the lake and home. However, it has been difficult to place the boats on the trailers, and the trailers have usually been backed into the water in order to achieve this result. In addition, the boats must be removed from the trailers in order to launch the boat. Further, the boat transport has required the separate trailers which adds significantly to the cost of the boat.

SUMMARY OF THE INVENTION

A principal feature of the present invention is the provision of an improved boat.

The boat of the present invention comprises, a hull having a space, a pair of wheels on opposed sides of the hull adjacent an upper portion of the hull, and a hitch adjacent a forward portion of the hull.

A feature of the invention is that the wheels may be placed on the ground for transport of the boat.

Another feature of the invention is that the hitch may be attached to a vehicle for transport of the boat.

Yet another feature of the invention is that the boat may be prepared for transport in a rapid and simplified manner.

Still another feature of the invention is that the hitch may be removed from the vehicle at the site of the water for launch of the boat in a simplified manner.

Yet another feature of the invention is that the boat need not be placed on a trailer either for transport from the water or home.

Still another feature of the invention is that it is not necessary to remove the boat from a trailer.

Another feature of the invention is that the boat eliminates the necessity for a trailer.

Thus, a feature of the invention is that the boat of the invention is of simplified construction and reduced cost.

A further feature of the invention is the provision of releasable covers for the wheels during use of the boat.

Further features of the invention will become more fully apparent in the following description of the embodiments of this invention, and from the appended claims.

DESCRIPTION OF THE PREFERRED EMBODIMENTS

Figure 1:
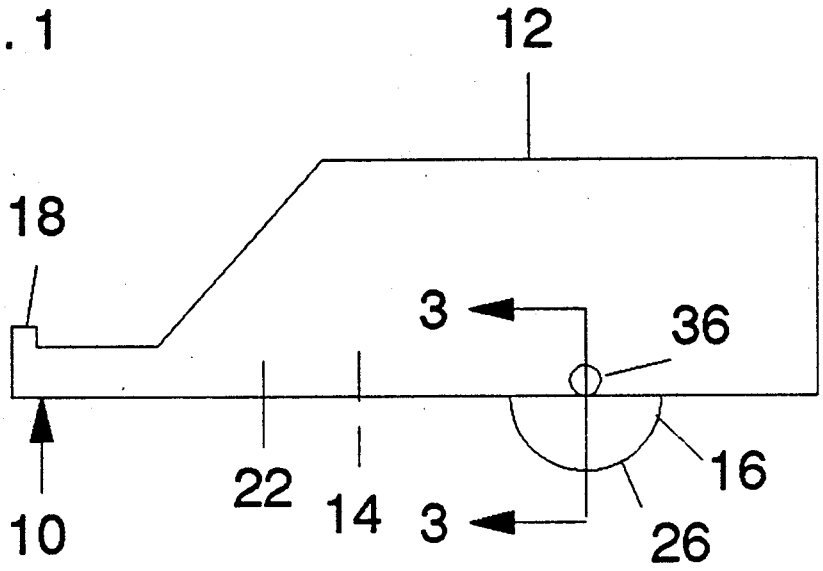
FIG. 1 is an elevational view of a boat of the present invention in an inverted configuration for transport.
Figure 2:
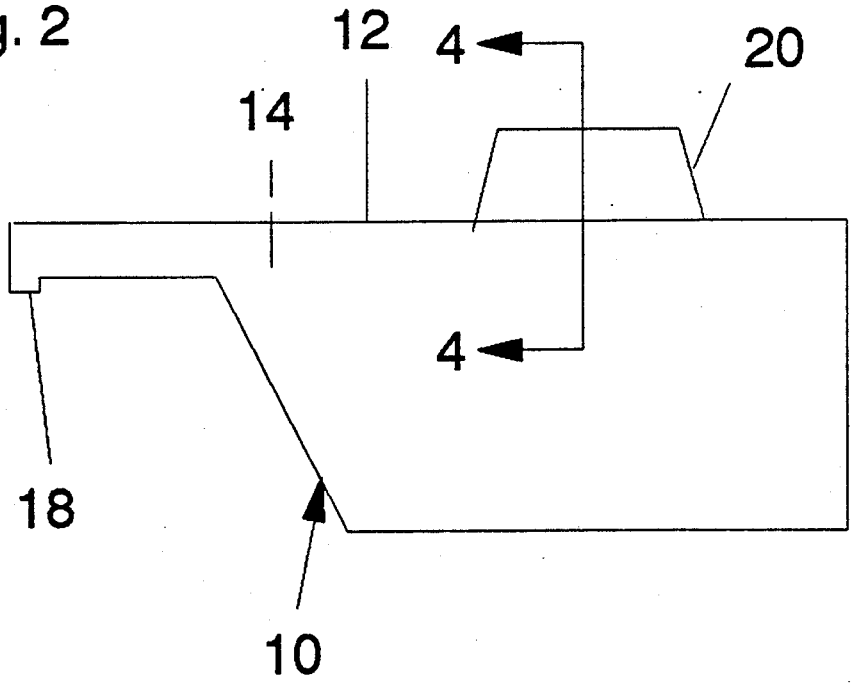
FIG. 2 is an elevational view of the boat in an upright configuration for use.
Figure 3:
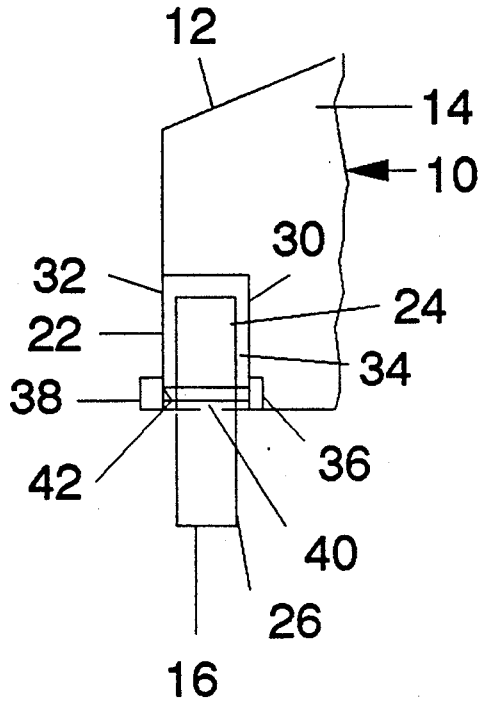
FIG. 3 is a sectional view taken substantially as indicated along the line 3—3 of FIG. 1.

Referring now to FIGS. 1 and 2, there is shown a boat generally designated 10 having a single hollow hull 12 defining a space 14 inside the hull 12 for receiving the user and suitable objects during use. The boat 10 has a pair of rotatable wheels 16 mounted on an upper portion 22 of opposed sides of the hull 12. A first inner portion 24 of the wheels 16 is located inside the hull 12, and a second outer portion 26 of the wheels project outwardly from the hull 12 for placement of the hull 12 in an inverted configuration in the absence of folding for transportation of the boat 10 with the space 14 being unobstructed by a remaining portion of the boat 10. The wheels 16 are mounted at a fixed position of the hull 12, and remain attached to the hull 12 when the boat 10 is placed in an upright position for use. In a preferred form, the wheels 16 are permanently mounted at the fixed position of the hull 12. The boat 10 has a hitch 18 adjacent a forward portion of the hull 12 for attachment to a suitable attachment, such as a ball, on the rear portion of a vehicle.

As shown in FIG. 2, the hull 12 has an inner wall 30 and an outer wall 32 at the opposed sides in the upper portion 22 of the hull 12, with the walls 30 and 32 defining a cavity 34 to receive the wheels 16. As shown, the boat 10 may have a bolt 36 passing through the walls 30 and 32 and a bore 40 in a central portion of the wheels 16 in order to rotatably mount the wheels 16 on the hull 12 with the wheels 16 being received in the cavities 34. In one form, the bolts 36 may have outer threaded ends 42, such that threaded nuts 38 may be releasably secured onto the bolts 36 in order to selectively and releasably hold the wheels 16 on the hull 12. If, desired, the nuts 38 may be removed from the bolts 36, and the bolts 36 may be removed from the hull 12 in order to remove the wheels 16 from the hull 12.

As shown in FIG. 1, the boat 10 is located in an inverted configuration for transport with the wheels 16 supporting the entire hull 12 in the inverted configuration of the hull 12. The hitch 18 is attached to the vehicle for transport of the boat between the water and the home.

When the boat is moved to the water, the hull 12 is inverted to an upright configuration as shown in FIG. 2, and a pair of hollow covers 20 may be placed over the projecting portion 26 of the wheels 16 preparatory for launch. In this configuration, the boat 10 is placed on the water for use. Thus, the boat 10 of the invention eliminates the necessity and cost of a separate trailer, in addition to being manipulated for transport and use in a simplified manner.

Figure 4:
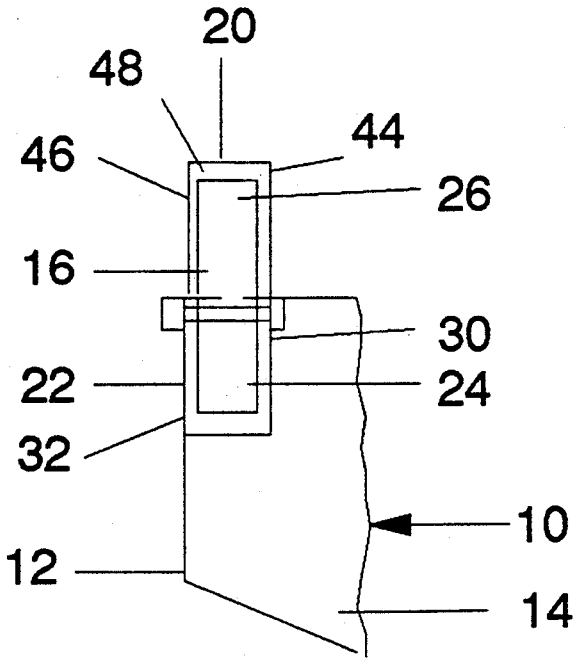
FIG. 4 is a sectional view taken substantially as indicated along the line 4—4 of FIG. 2.

As shown in FIG. 4, the covers 20 may have an inner wall 44 and an outer wall 46 defining a cavity 48 to receive the projecting portions 26 of the wheels 16. The covers 20 may be releasably attached to the inner and outer walls 30 and 32 over the wheels 16 in any suitable manner, such that the covers may close the cavities 34 of the hull 12 during use of the boat 10.

The foregoing detailed description has been given for clearness of understanding only, and no unnecessary limitations should be understood therefrom, as modification will be obvious to those skilled in the art.

What is claimed is:

1. A mobile boat comprising, a single hull having a space, a pair of wheels mounted on an upper portion of opposed sides of the hull with at least a first portion of the wheels being located inside the hull and a second portion of the wheels projecting outwardly from the hull for placement of the hull in an inverted configuration in the absence of folding for transport, and with the wheels supporting the entire hull in the inverted configuration of the hll, and a hitch for a vehicle adjacetn a forward portion of the hull, including a pair of hollow covers releasably covering the projecting second portion of said wheels.

2. The boat of claim 1 wherein the covers have inner and outer walls defining a cavity to receive the second portion of the wheels.

3. The boat of claim 1 wherein the wheels are mounted at a fixed position of the hull, and remain attached to the hull when the boat is placed in an upright position for use.

4. The boat of claim 1 wherein the hull has inner and outer walls defining a cavity in the upper portion of the hull to receive a first portion of the wheels in the cavity, and including means for rotatably mounting the wheels in the cavity.

5. The boat of claim 4 wherein the mounting means releasably mounts the first portion of the wheels in the cavity.

6. The boat of claim 5 wherein the mounting means comprises a bolt extending between the inner and outer walls of the hull, and extending through a central portion of the wheels.

* * * * *